US007023301B2

(12) United States Patent
Kawahara et al.

(10) Patent No.: US 7,023,301 B2
(45) Date of Patent: Apr. 4, 2006

(54) LAMINATED FILTER WITH A SINGLE SHIELD CONDUCTOR, INTEGRATED DEVICE, AND COMMUNICATION APPARATUS

(75) Inventors: Emiko Kawahara, Sakai (JP); Toru Yamada, Katano (JP); Tsutomu Matsumura, Yao (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 221 days.

(21) Appl. No.: 10/145,065

(22) Filed: May 14, 2002

(65) Prior Publication Data

US 2002/0180561 A1 Dec. 5, 2002

(30) Foreign Application Priority Data

May 16, 2001 (JP) ..... 2001-146975

(51) Int. Cl.
*H01P 1/203* (2006.01)

(52) U.S. Cl. ..... 333/204; 333/185

(58) Field of Classification Search ..... 133/132, 133/134, 175, 185, 204
See application file for complete search history.

(56) References Cited

U.S. PATENT DOCUMENTS 5,406,235 A * 4/1995 Hayashi ..... 333/204
5,608,364 A * 3/1997 Hirai et al. ..... 333/204
5,668,511 A * 9/1997 Furutani et al. ..... 333/204
6,097,268 A * 8/2000 Watanabe et al. ..... 333/132
6,140,891 A * 10/2000 Nakakubo et al. ..... 333/204
6,147,571 A * 11/2000 Kitazawa et al. ..... 333/134 X
6,411,178 B1 * 6/2002 Matsumura et al. ..... 333/134
6,414,567 B1 * 7/2002 Matsumura et al. ..... 333/134
6,608,534 B1 * 8/2003 Kushitani et al. ..... 333/134 X

FOREIGN PATENT DOCUMENTS

| | | |
|---|---|---|
| EP | 1 079 520 | 2/2001 |
| EP | 1 094 538 | 4/2001 |
| JP | 62-40801 | 2/1987 |
| JP | 2000-244202 | 9/2000 |
| JP | 2000244202 A * | 9/2000 |
| JP | 2001119209 A * | 4/2001 |

OTHER PUBLICATIONS

European Search Report corresonding to application No. EP 02 01 0844 dated Oct. 2, 2003.

* cited by examiner

*Primary Examiner*—Benny Lee
(74) *Attorney, Agent, or Firm*—RatnerPrestia

(57) ABSTRACT

To provide a laminated band-pass filter comprising at least two band-pass filters without reducing the Q factor of strip line conductors constituting the band-pass filters. A laminated band-pass filter comprises an integrated device formed by laminating and integrating a plurality of dielectric layers together, a plurality of internal grounding conductors formed inside the integrated device, and two band-pass filters sandwiched between two of the plurality of grounding conductors and formed inside the integrated device. One of the band-pass filters has strip line conductors, and the other has strip line conductors. The two band-pass filters are formed in different areas with a boundary between these areas corresponding to a predetermined cross section substantially perpendicular to the grounding conductors.

21 Claims, 11 Drawing Sheets

LAMINATED FILTER WITH A SINGLE SHIELD CONDUCTOR, INTEGRATED DEVICE, AND COMMUNICATION APPARATUS

BACKGROUND OF THE INVENTION

1. Field of the Invention

The present invention relates to a laminated filter, integrated device, and communication apparatus which are used in high-frequency radio equipment such as a cellular telephone.

2. Related Art of the Invention

In recent years, owing to a continued reduction in size of communication equipment, dielectric laminated filters, which are effective in size reduction, have often been used as high frequency filters. An example of such a laminated band-pass filter will be described with reference to the drawings.

FIG. 4 is a sectional view of a conventional laminated band-pass filter 400. In this figure, the laminated band-pass filter 400, of thickness d, formed by laminating and integrating a plurality of dielectric layers together, is sandwiched between internal grounding conductors 401 and 402, and a first band-pass filter 404 is formed on a top surface of the internal grounding conductor 401, with an internal grounding conductor 403 arranged on the first band-pass filter and a second band-pass filter 405 formed on the internal grounding conductor 403. Strip line conductors 410 are provided substantially in the center of each of the first and second band-pass filters 404 and 405 in a thickness direction thereof.

The first and second band-pass filters 404 and 405 are laminated together while being shielded by the internal grounding conductor 403, thereby reducing the interference between the two filters.

However, in the above described configuration, the interval between the internal grounding conductors sandwiching the corresponding one of the first and second band-pass filters 404 and 405 therebetween (i.e. the interval between the internal grounding conductors 402 and 403 and the interval between the internal grounding conductors 401 and 403) is smaller than that between interval between internal grounding conductors for a single band-pass filter 501 (see FIG. 5) formed inside an integrated device (i.e. the interval between internal grounding conductors 511 and 512).

For comparison, the sectional view in FIG. 5 shows a conventional laminated band-pass filter 500 having the band-pass filter 501.

In FIG. 5, the single band-pass filter 501, formed inside an integrated device having a thickness d, is sandwiched between the internal grounding conductors 511 and 512. Strip line conductors 510 (see FIG. 5) are provided substantially in the center of the band-pass filter 501 in the thickness direction thereof.

The inventors have found that in the first and second band-pass filters 404 and 405 (see FIG. 4), the Q factor of the strip line conductors, which constitute the band-pass filter, may decrease to increase an insertion loss to this device compared to the band-pass filter 501 (see FIG. 5).

More specifically, as shown in FIG. 10 illustrating simulation-based analysis of the behavior of the Q factor of a high-frequency resonance circuit which behavior is observed when the shield interval is varied, when the high-frequency resonance circuit uses a frequency of 1,200 MHz, its Q factor is (1) about 38 if the shield interval (corresponding to the thickness d, described previously) is 0.6 mm, (2) about 34 if the shield interval is 0.5 mm and (3) about 26 if the shield interval is 0.4 mm. This high-frequency resonance circuit is constructed similarly to the laminated band-pass filter 500 described previously (see FIG. 5), and the strip line conductors are provided substantially in the center of the band-pass filter in the thickness direction thereof.

SUMMARY OF THE INVENTION

In view of the above described problems, it is an object of the present invention to provide a small-sized and small-loss laminated filter, integrated device, and communication apparatus.

One aspect of the present invention is a laminated filter comprising:

- a plurality of grounding conductors formed inside or outside a integrated device formed by laminating and integrating a plurality of dielectric layers together;
- a first filter sandwiched between two of the grounding conductors which have a shielding function; and
- a second filter sandwiched between the two grounding conductors.

Another aspect of the present invention is the laminated filter, wherein the first filter is a band-pass filter, and the second filter is a band-pass filter.

Still another aspect of the present invention is the laminated filter, wherein the first filter and the second filter are formed in different areas with a boundary between these areas corresponding to a predetermined cross section substantially perpendicular to the two grounding conductors.

Yet still another aspect of the present invention is the laminated filter, further comprising a shielding conductor formed substantially in the predetermined cross section and connected to the plurality of grounding conductors to shield electromagnetic induction between the first filter and the second filter.

Still yet another aspect of the present invention is the laminated filter, wherein via conductors are used to connect the shielding conductor to the grounding conductors.

A further aspect of the present invention is the laminated filter, wherein some of the plurality of grounding conductors are formed inside the integrated device,

- the first filter has a plurality of input and output terminals formed inside or outside the integrated device, a grounding terminal formed inside or outside the integrated device, a capacitive conductor formed inside the integrated device, and a plurality of strip line conductors formed inside the integrated device,
- the grounding terminal is electrically connected to the grounding conductors formed inside the integrated device, and
- the plurality of strip line conductors each have one end electrically connected to the capacitive conductor and the other end electrically connected to the grounding conductors formed inside the integrated device.

A still further aspect of the present invention is the laminated filter, wherein the plurality of strip line conductors are two strip line conductors installed in parallel, and the other ends of the two parallel strip line conductors are not adjacent to each other.

A yet further aspect of the present invention is the laminated filter, wherein the plurality of input and output terminals are two input and output terminals installed in proximity to each other, the grounding terminal is provided between the two input and output terminals installed in proximity to each other.

A still yet further aspect of the present invention is the laminated filter, wherein the second filter has a plurality of input and output terminals formed inside or outside the integrated device, and a plurality of input and output terminals of the first filter and a plurality of input and output terminals of the second filter are provided in the same layer of the integrated device symmetrically with respect to the center of the layer.

An additional aspect of the present invention is the laminated filter, further comprising a predetermined circuit element electrically connected to the plurality of input and output terminals.

A still additional aspect of the present invention is the laminated filter, wherein the first filter has a layer having a resonator capacitive conductor required to constitute a resonator, a layer having input and output capacitive conductors connected to the input and output terminals, and a layer having an interstage capacitive conductor or a cross coupling capacitive conductor, the second filter has a layer having a resonator capacitive conductor required to constitute a resonator, a layer having input and out put capacitive conductors connected to the input and output terminals, and a layer having an interstage capacitive conductor or a cross coupling capacitive conductor, (a) the layer having the resonator capacitive conductor of the first filter and the layer having the resonator capacitive conductor of the second filter are present in different layers of the integrated device, b) the layer having the input and output capacitive conductors of the first filter and the layer having the input and output capacitive conductors of the second filter are present in different layers of the integrated device, or (c) the layer having the interstage capacitive conductor or cross coupling capacitive conductor of the first filter and the layer having the interstage capacitive conductor or cross coupling capacitive conductor of the second filter are present in different layers of the integrated device.

A yet additional aspect of the present invention is the laminated filter, wherein the first filter has a plurality of strip line conductors formed substantially midway between the two grounding conductors in a thickness direction of the integrated device.

A still yet additional aspect of the present invention is the laminated filter, wherein the first filter has a plurality of capacitive conductors and a plurality of strip line conductors, and of the plurality of capacitive conductors, the interstage capacitive conductor, cross coupling capacitive conductor, and input and output capacitive conductors are formed substantially midway between either of the two grounding conductors and the plurality of strip line conductors in the thickness direction of the integrated device.

A supplementary aspect of the present invention is the laminated filter, wherein the first filter has a plurality of capacitive conductors and a plurality of strip line conductors, and a predetermined one of those of the plurality of capacitive conductors which are connected to the strip line conductors electrically in parallel is formed opposite either of the two grounding conductors.

A still supplementary aspect of the present invention is the laminated filter, further comprising a predetermined grounding conductor formed so that the predetermined capacitive conductor is sandwiched between the predetermined grounding conductor and either of the two grounding conductors.

A yet supplementary aspect of the present invention is the laminated filter, wherein the first filter and the second filter use different frequency bands as pass bands.

A still yet supplementary aspect of the present invention is the laminated filter, wherein one of the first and second filters which use a lower frequency band as a pass band has a larger occupied volume in the integrated device.

Another aspect of the present invention is the laminated filter, wherein a crystal phase forming the dielectric layers of the integrated device has any of $Al_2O_3$, MgO, $SiO_2$, and ROa for R denoting at least one of La, Ce, Pr, Nd, Sm, and Gd and a denoting a numerical value stoichiometrically determined depending on the valence of said R.

Still another aspect of the present invention is the laminated filter, wherein the first filter is a band-pass filter, and the second filter is a band elimination filter.

Yet still another aspect of the present invention is the laminated filter, wherein the first filter is a band elimination filter, and the second filter is a band elimination filter.

Still yet another aspect of the present invention is a integrated device comprising:

the integrated device containing the laminated filter, and an integrated circuit mounted in the integrated device.

A further aspect of the present invention is a communication apparatus comprising:

transmitting and receiving means of executing transmission and/or reception, and the laminated filter which filters a transmitted signal used for the transmission and/or a received signal used for the reception.

DESCRIPTION OF SYMBOLS

Figure 1:
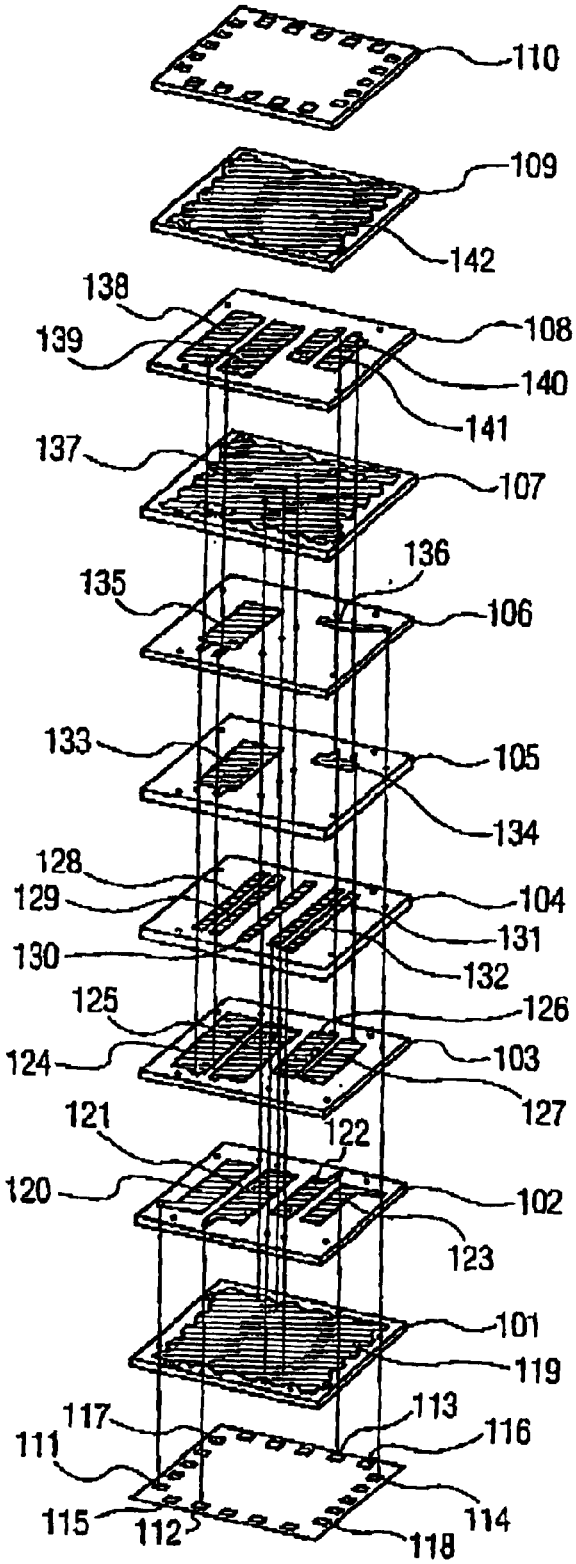
FIG. 1 is an exploded perspective view of a laminated band-pass filter according to Embodiment 1 of the present invention.

101 to 110, 301 to 311 Dielectric layers

111 to 114, 312 to 315 input and output terminals

115 to 118, 316 to 319 Grounding terminals

119, 137, 142, 320, 340, 343 internal grounding conductors

120 to 127, 133 to 136, 139 to 141, 321 to 328, 334 to 339, 341, 342 Capacitive conductors

128 to 132, 329 to 333 Strip line conductors

201 to 204, 208 to 212, 216 Capacitances

205, 206, 211, 212 Inductors

207, 215 Mutual inductances

PREFERRED EMBODIMENTS OF THE INVENTION

A laminated band-pass filter according to an embodiment of the present invention will be described below with reference to the drawings.

Embodiment 1

FIG. 1 is an exploded perspective view of a laminated band-pass filter according to Embodiment 1 of the present invention.

The laminated band-pass filter of this embodiment is characterized in that it is possible to provide such a design that a (1) first band-pass filter (In the left of the drawing) having strip line conductors 128 and 129 spaced at a given interval and electromagnetically coupled together and a (2) second band-pass filter (in the right of the drawing) having strip line conductors 131 and 132 spaced at a given interval and electromagnetically coupled together are not disposed in the direction of laminating but in the direction perpendicular thereto, so that there is a sufficient interval between outermost internal grounding conductors 119 and 142 sandwiching the first and second band-pass filters therebetween and functioning as shield layers, thereby suppressing a decrease in Q factor of each of the strip line conductors 128, 129, 131, and 132.

As shown in FIG. 1, the laminated band-pass filter according to Embodiment 1 of the present invention comprises sequentially laminated dielectric layers 101, 102, 103, 104, 105, 106, 107, 108, 109 and 110, and the integrated device has a size of 5.0×5.0 mm and a height of 0.8 mm. Further, each dielectric layer is composed of a crystal phase having a dielectric constant $\epsilon r$ of 7 and a glass phase. The crystal phase is composed of $Mg_2SiO_4$, whereas the glass phase is composed of Si—Ba—La—B—O-system. The integrated device has input and output terminals 111, 112, 113 and 114 and grounding terminals 115, 116, 117 and 118 formed on a bottom surface thereof.

The dielectric layers 101, 107, and 109 have internal grounding conductors 119, 137, and 142, respectively, arranged on top surfaces thereof and connected to the grounding terminals 115, 116, 117 and 118 through via conductors. The dielectric layer 102 has capacitive conductors 120, 121, 122 and 123 arranged on a top surface thereof and connected to the input and output terminals 111, 112, 113 and 114, respectively, through via conductors. The dielectric layer 103 has capacitive conductors 124, 125, 126 and 127 arranged on a top surface thereof, and the dielectric layer 104 has strip line conductors 128, 129, 130, 131 and 132 arranged on a top surface thereof. Further, the dielectric layer 105 has capacitive conductors 133 and 134 arranged on a top surface thereof, the dielectric layer 106 has capacitive conductors 135 and 136 arranged on a top surface thereof, and the dielectric layer 108 has capacitive conductors 138, 139, 140 and 141 arranged on a top surface thereof.

Furthermore, the strip line conductor 128 has one end thereof connected to the internal grounding conductor 119 through a via conductor and the other end thereof connected to each of the capacitive conductors 124, 135, and 138 through a via conductor. Likewise, the strip line conductor 129 has one end thereof connected to the internal grounding conductor 119 through a via conductor and the other end thereof connected to each of the capacitive conductors 125, 133, and 139 through a via conductor. The strip line conductor 131 has one end thereof connected to the internal grounding conductor 119 through a via conductor and the other end thereof connected to each of the capacitive conductors 126, 134, and 140 through a via conductor. The strip line conductor 132 has one end thereof connected to the internal grounding conductor 119 through a via conductor and the other end thereof connected to each of the capacitive conductors 127 and 141 through a via conductor.

Further, the capacitive conductor 136 is arranged opposite the capacitive conductor 134 and connected to the input and output terminal 114 through a via conductor. The strip line conductor 130 is connected to the internal grounding conductor 137 through three via conductors penetrating three via holes formed at the boundary between the first and second band-pass filters.

The strip line conductor 130 corresponds to a shielding conductor according to the present invention, and the input and output terminals 111, 112, 113 and 114 correspond to input and output terminals according to the present invention. The grounding terminals 115, 116, 117 and 118 correspond to grounding terminals according to the present invention, the capacitive conductors 120, 121, 122, 123, 124, 125, 126 and 127, 133, 134, 135 and 136, and 139, 140 and 141 correspond to capacitive conductors according to the present invention, and the strip line conductors 128, 129, 130, 131 and 132 correspond to strip line conductors according to the present invention. Further, the dielectric layers 101, 102, 103, 104, 105, 106, 107, 108, 109 and 110 correspond to dielectric layers according to the present invention, the internal grounding conductors 119, 137, and 142 correspond to grounding conductors according to the present invention, and the internal grounding conductors 119 and 142 correspond to two grounding conductors according to the present invention having a shielding function.

In this case, the internal grounding conductor 137 is not used for shielding and is not essential. However, the internal grounding conductor 137 is capacitively coupled to the capacitive conductors 138, 139, 140 and 141 and has a function for keeping the capacitances of the capacitive conductors 138, 139, 140 and 141 sufficient even if the stack is used in a high-frequency band.

As shown in FIG. 1, the strip line conductor 130, which operates as a shielding conductor, is provided between the strip line conductors 128 and 129 and the strip line conductors 131 and 132, each pair of strip conductors constituting the corresponding band-pass filter. This arrangement impedes the two laminated band-pass filters from affecting each other, while ensuring that these band-pass filters are isolated from each other.

Further, the strip line conductors 128, 129, 131, and 132, which constitute the two laminated band-pass filters, are arranged substantially midway between the internal grounding conductors 119 and 137. This arrangement impedes the Q factor of the strip line conductors from decreasing, thereby providing a laminated band-pass filter undergoing a small insertion loss.

Figure 2:
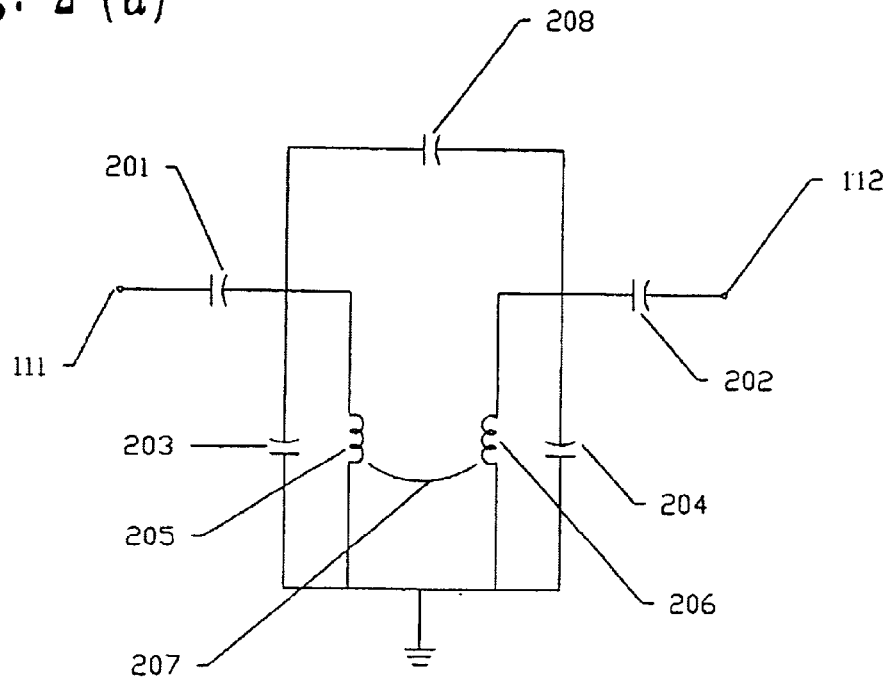
FIG. 2(*a*) is an equivalent circuit diagram of a band-pass filter according to Embodiments 1 and 2 of the present invention, and FIG. 2(*b*) is an equivalent circuit diagram of a band-pass filter according to Embodiments 1 and 3 of the present invention.
Figure 2:
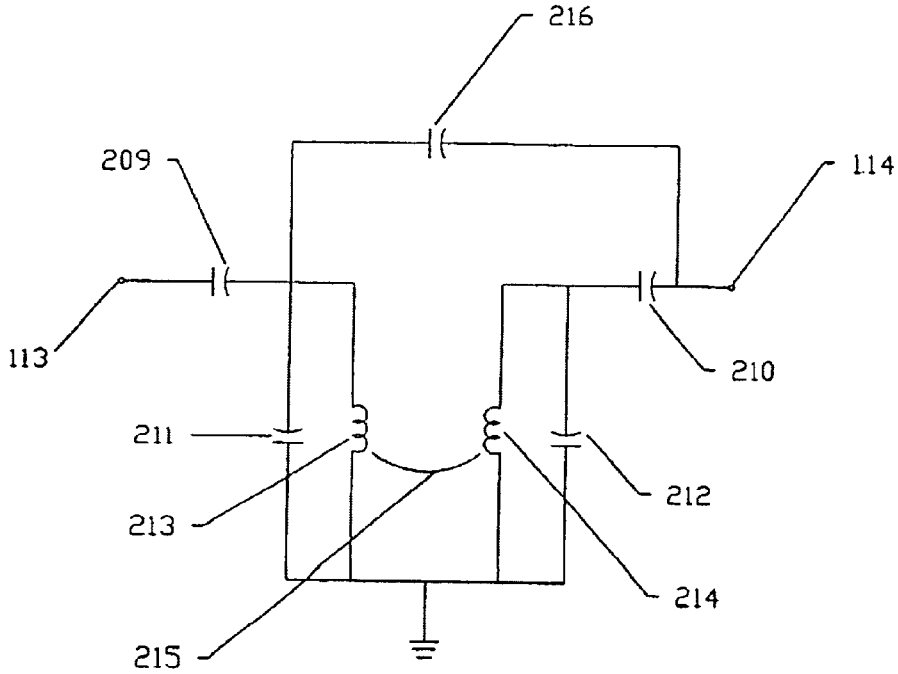

Further, the capacitive conductors 120, 121, 122, 123, 124, 125, 126 and 127, which form capacitances 201 and 202 (see FIG. 2(*a*)) as well as 209 and 210 (see FIG. 2(*b*)), are arranged substantially midway between the strip line conductor layer and the internal grounding conductor 119, and the capacitive conductors 133, 134, 135 and 136, which form capacitances 208 (see FIG. 2(*a*)) and 216 (see FIG. 2(*b*)), are arranged substantially midway between the strip line conductor layer and the internal grounding conductor 137. This arrangement impedes the Q factor of the capacitance provided by each capacitive conductor from decreasing, thereby providing a laminated band-pass filter undergoing a small insertion loss.

Furthermore, the capacitive conductors 138, 139, 140 and 141 are arranged opposite the grounding conductors 137 and 142, and the capacitive conductors 138, 139, 140 and 141 are sandwiched between the two grounding conductors 137 and 142. This arrangement enables a capacitive conductor layer to be omitted to reduce the height of the device, and also enables larger capacitances to be formed to increase the degree of freedom of design.

Moreover, the grounding terminal 115 is provided between the input and output terminals 111 and 112 of the first band-pass filter, and the grounding terminal 116 is provided between the input and output terminals 113 and 114 of the second band-pass filter to ensure the isolation between the input and output terminals of the band-pass filters. Further, the pair of input and output terminals 111 and 112 of the first band-pass filter and the pair of input and output terminals 113 and 114 of the second band-pass filter are arranged symmetrically with respect to the center of the integrated device, thereby ensuring that the two band-pass filters are isolated from each other.

Then, the circuit configuration of the laminated band-pass filter constructed as described above will be described with reference to FIGS. 2(*a*) to 2(*b*).

FIGS. 2(*a*) and 2(*b*) show equivalent circuits of the first and second band-pass filters, respectively, in FIG. 1. Those elements in FIGS. 2(*a*) and 2(*b*) which correspond to FIG. 1 are denoted by the same reference numerals.

The circuit configuration of FIG. 2(*a*) forms an attenuating pole on a low-frequency side of a pass band, whereas the circuit configuration of FIG. 2(*b*) forms an attenuating pole on a high-frequency side of a pass band. Accordingly, in this embodiment, the circuit configuration of FIG. 2(*a*) is used for the first band-pass filter, whereas the circuit configuration of FIG. 2(*b*) is used for the second band-pass filter. However, the present invention is not limited to this aspect, but it should be appreciated that, for example, the circuit configuration of FIG. 2(*a*) may be used for both the first and second band-pass filters.

First, the configuration of the first band-pass filter having the equivalent circuit in FIG. 2(*a*) will be described.

The capacitance 201 is an input and output capacitive conductor formed by the capacitive conductors 120 and 124 (see FIG. 1). Further, the capacitance 202 is an input and output capacitive conductor formed by the capacitive conductors 121 and 125 (see FIG. 1).

The capacitance 208 is an interstage capacitive conductor by the capacitive conductors 133 and 135 (see FIG. 1).

The capacitance 203 is a resonator capacitive conductor formed by the grounding conductor 137 (see FIG. 1), the grounding conductor 142 (see FIG. 1), and the capacitive conductor 138 (see FIG. 1), located between the grounding conductor 137 and 142. Further, the capacitance 204 is a resonator capacitive conductor formed by the grounding conductor 137 (see FIG. 1), the grounding conductor 142 (see FIG. 1), and the capacitive conductor 139 (see FIG. 1), located between the grounding conductor 137 and 142.

Inductors 205 and 206 are formed by the strip line conductors 128 and 129 (see FIG. 1).

Furthermore, the capacitances 201 and 202 are connected to the input and output terminals 111 and 112 (see FIG. 1), respectively. Further, the inductor 205 and the capacitance 203 are connected in parallel, the inductor 206 and the capacitance 204 are connected in parallel, and these inductors and capacitances are coupled together by the capacitance 208, an interstage capacitive conductor, to constitute a two-staged polarized band-pass filter. Further, the mutual inductance 207 acts between the inductors 205 and 206, and the capacitance 208 connected in parallel to the mutual inductor 207 constitutes a resonance circuit.

In this manner, an attenuating pole is formed on a low frequency side of the pass band to constitute the first band-pass filter, which has the equivalent circuit in FIG. 2(*a*).

Then, the second band-pass filter, which has the equivalent circuit in FIG. 2(*b*), will be described.

The capacitance 209 is an input and output capacitive conductor formed by the capacitive conductors 122 and 126 (see FIG. 1). Further, the capacitance 210 is an input and output capacitive conductor formed by the capacitive conductors 123 and 127 (see FIG. 1).

The capacitance 216 is a cross coupling capacitive conductor formed by the grounding conductors 134 and 136 (see FIG. 1).

The capacitance 211 is a resonator capacitive conductor formed by the grounding conductor 137 (see FIG. 1), the grounding conductor 142 (see FIG. 1), and the capacitive conductor 140 (see FIG. 1), located between the grounding conductor 137 and 142. Further, the capacitance 212 is a resonator capacitive conductor formed by the grounding conductor 137 (see FIG. 1), the grounding conductor 142 (see FIG. 1), and the capacitive conductor 141 (see FIG. 1), located between the grounding conductor 137 and 142.

Inductors 213 and 214 are formed by the strip line conductors 131 and 132 (see FIG. 1). Furthermore, the capacitances 209 and 210 are connected to the input and output terminals 113 and 114 (see FIG. 1), respectively. Further, the inductor 213 and the capacitance 211 are connected in parallel, and the inductor 214 and the capacitance 212 are connected in parallel, thereby constitute a two-staged polarized band-pass filter. Further, the mutual inductance 215 acts between the inductors 213 and 214, and the capacitive conductor 136 (see FIG. 1), which forms the capacitance 216, a cross coupling capacitive conductor, is connected to the input and output terminal 114 (see FIG. 1) to constitute a resonance circuit.

In this manner, an attenuating pole is formed on a high frequency side of the pass band to constitute the second band-pass filter, which has the equivalent circuit in FIG. 2(*b*).

Further, the strip line conductor 130, formed on the dielectric layer 104, is grounded through the plurality of via conductors to act as a shielding conductor that inhibits the electromagnetic coupling between the strip line conductors 128 and 129, which constitute the first band-pass filter, and the strip line conductors 131 and 132, which constitute the second band-pass filter.

As described above, according to Embodiment 1, a laminated band-pass filter having two band-pass filters can be constructed without reducing the interval between the internal grounding conductors. This construction prevents the Q factor of the strip line conductors, which constitute the two band-pass filters, from decreasing, and provides a laminated band-pass filter provided with two small-loss band-pass filters.

In the above described embodiment, the strip line conductor 130, which acts as a shielding conductor, is connected to the internal grounding conductor 137 through the three via conductors (see FIG. 1). However, the present invention is not limited to this aspect, but the strip line conductor 130, which acts as a shielding conductor, may be grounded via an external conductor.

Further, in the above described embodiment, those ends of the strip line conductors 128 and 129 which are located on the same side are connected to the internal grounding conductor 119 (see FIG. 1). However, the present invention is not limited to this aspect, those ends of the strip line conductors 128 and 129 which are located on the different sides may be connected to the internal grounding conductor 119. If those ends of the strip line conductors 128 and 129 which are located on the different sides is thus connected to the internal grounding conductor 119, an available band is widened compared to the case in which those ends of the strip line conductors 128 and 129 which are located on the same side are connected to the internal grounding conductor 119.

Embodiment 2

A laminated band-pass filter according to Embodiment 2 of the present invention will be described below with reference to the drawings.

Figure 3:
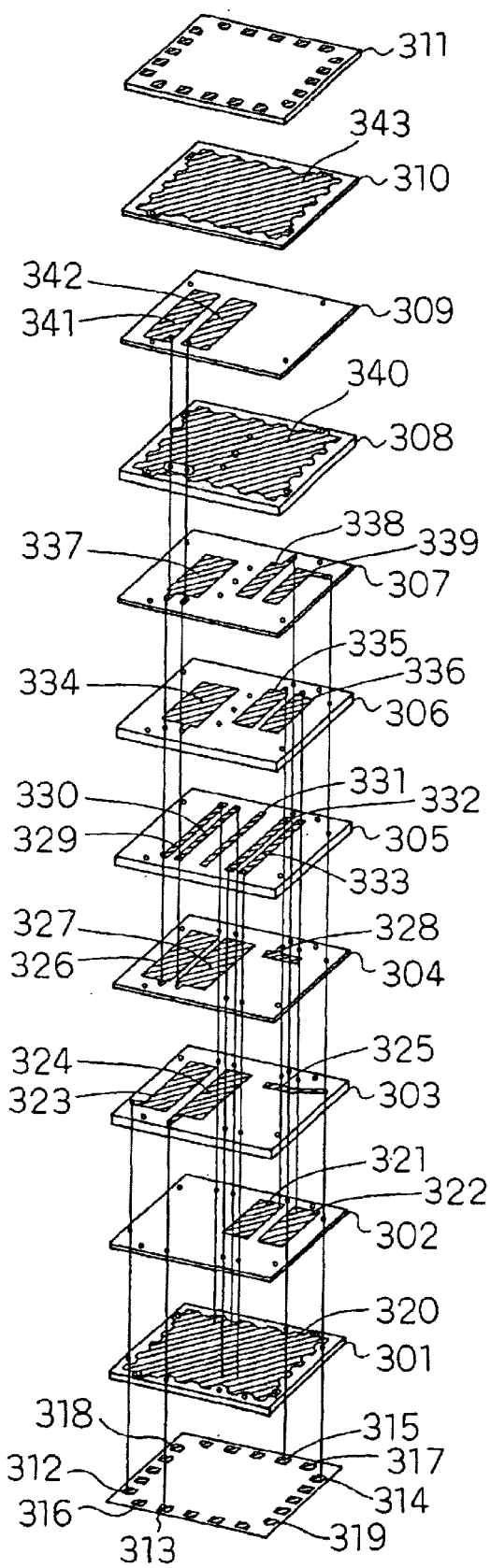
FIG. 3 is an exploded perspective view of a laminated band-pass filter according to Embodiment 2 of the present invention.
Figure 4:
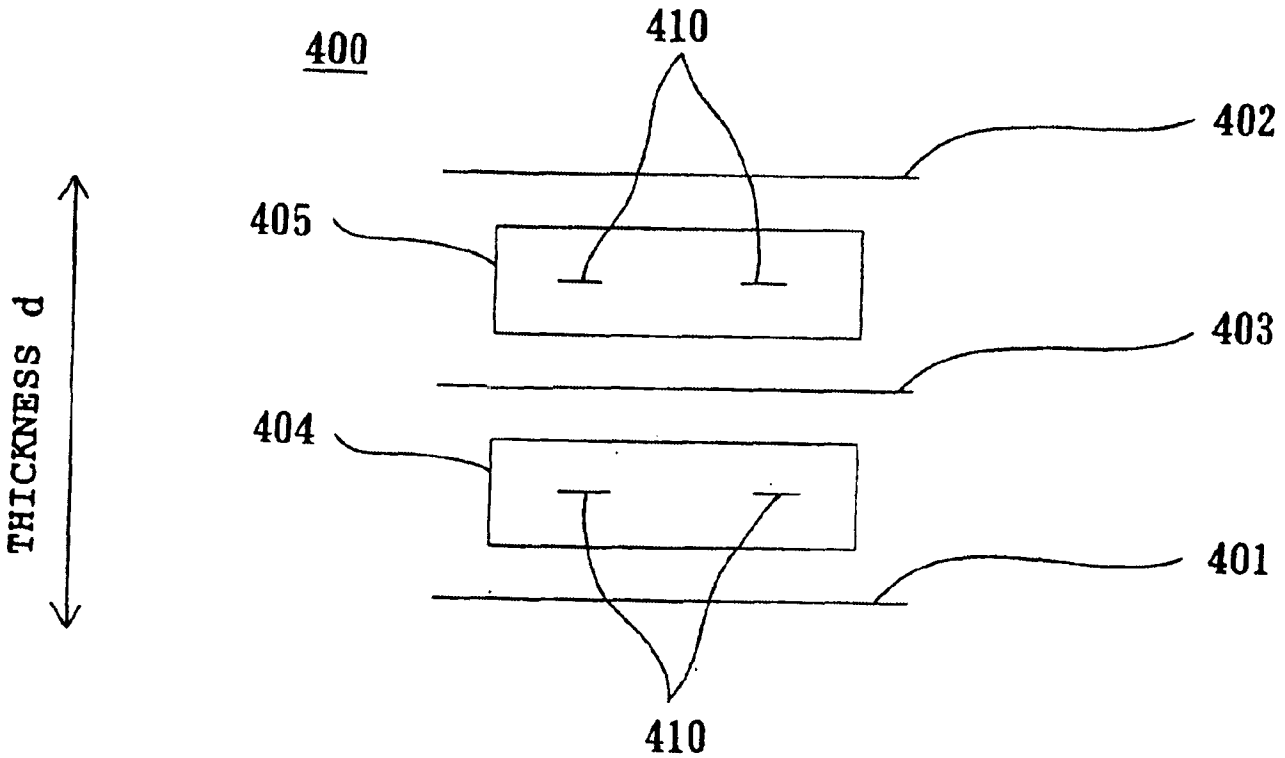
Fig. 4 PRIOR ART
FIG. 4 is a sectional view of a conventional laminated band-pass filter 400.
Figure 5:
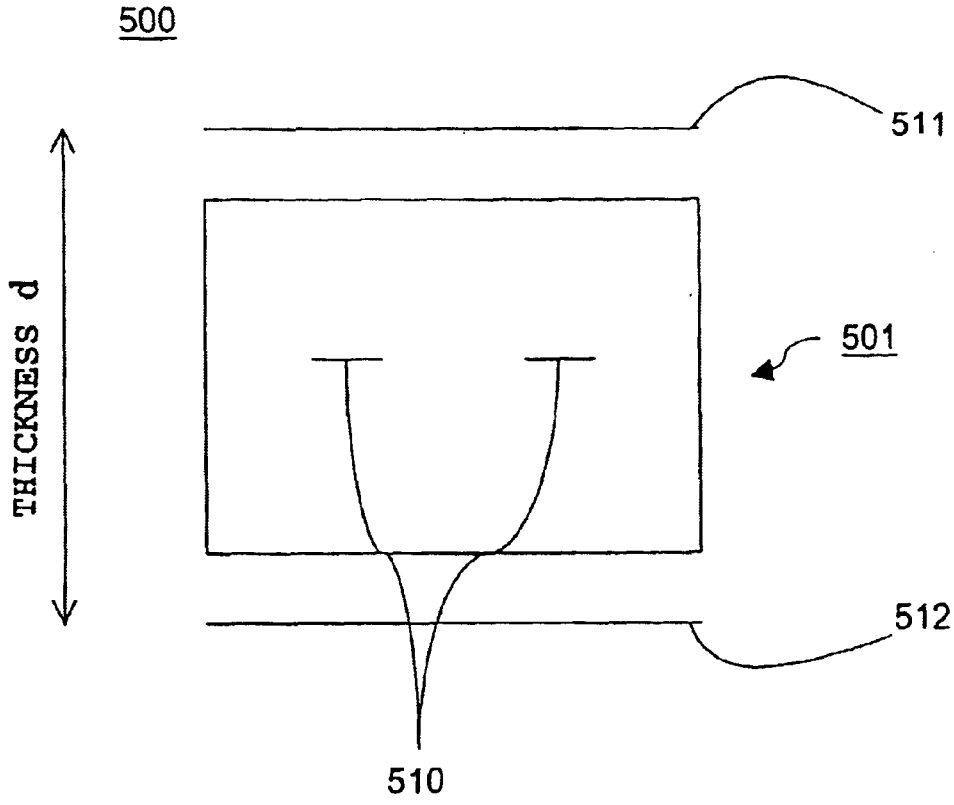
Fig. 5 PRIOR ART
FIG. 5 is a sectional view of a conventional laminated band-pass filter 500.

FIG. 3 is an exploded perspective view of the laminated band-pass filter according to Embodiment 2 of the present invention. As shown in this figure, the laminated band-pass filter according to Embodiment 2 of the present invention comprises sequentially laminated dielectric layers 301, 302, 303, 304, 305, 306, 307, 308, 309, 310 and 311, and the integrated device has a size of 5.0×5.0 mm and a height of 0.8 mm. Further, each dielectric layer is composed of a crystal phase having a dielectric constant $\epsilon r$ of 7 and a glass phase. The crystal phase is composed of $Mg_2SiO_4$, whereas the glass phase is composed of Si—Ba—La—B—O-system. The integrated device has input and output terminals 312, 313, 314 and 315 and grounding terminals 316, 317, 318 and 319 formed on a bottom surface thereof.

The dielectric layers 301, 308, and 310 have internal grounding conductors 320, 340, and 343, respectively, arranged on top surfaces thereof and connected to the grounding terminals 316, 317, 318 and 319 through via conductors. The dielectric layer 302 has capacitive conductors 321 and 322 arranged on a top surface thereof, and the dielectric layer 303 has capacitive conductors 323, 324 and 325 arranged on a top surface thereof. All these capacitive conductors are connected to the input and output terminals 312, 313 and 314, respectively, through via conductors.

The dielectric layer 304 has capacitive conductors 326, 327 and 328 arranged on a top surface thereof, and the dielectric layer 305 has strip line conductors 329, 330, 331, 332 and 333 arranged on a top surface thereof. Further, the dielectric layer 306 has capacitive conductors 334 and 336 arranged on a top surface thereof, the dielectric layer 307 has capacitive conductors 337, 338 and 339 arranged on a top surface thereof, and the dielectric layer 309 has capacitive conductors 341 and 342 arranged on a top surface thereof.

Furthermore, the strip line conductor 329 has one end thereof connected to the internal grounding conductor 320 through a via conductor and the other end thereof connected to each of the capacitive conductors 326, 337, and 341 through a via conductor. Likewise, the strip line conductor 330 has one end thereof connected to the internal grounding conductor 320 through a via conductor and the other end thereof connected to each of the capacitive conductors 327, 334, and 342 through a via conductor. The strip line conductor 332 has one end thereof connected to the internal grounding conductor 320 through a via conductor and the other end thereof connected to each of the capacitive conductors 321, 328, and 335 through a via conductor. The strip line conductor 333 has one end thereof connected to the internal grounding conductor 320 through a via conductor and the other end thereof connected to each of the capacitive conductors 322 and 336 through a via conductor.

Further, the capacitive conductors 338 and 339 are arranged opposite the capacitive conductors 335 and 336 and connected to the input and output terminals 315 and 314, respectively, through via conductors. The strip line conductor 331 is connected to the internal grounding conductor 340 through three via conductors.

The strip line conductor 331 corresponds to a shielding conductor according to the present invention, and the input and output terminals 312, 313, 314 and 315 correspond to input and output terminals according to the present invention. The grounding terminals 316, 317, 318 and 319 correspond to grounding terminals according to the present invention, the capacitive conductors 321, 322, 323, 324, 325, 326, 327 and 328, 334, 335, 336, 337, 338 and 339, 341, and 342 correspond to capacitive conductors according to the present invention, and the strip line conductors 329, 330, 331, 332 and 333 correspond to strip line conductors according to the present invention. Further, the dielectric layers 301, 302, 303, 304, 305, 306, 307, 308, 309, 310 and 311 correspond to dielectric layers according to the present invention, the internal grounding conductors 320, 340, and 343 correspond to grounding conductors according to the present invention, and the internal grounding conductors 320 and 343 correspond to two grounding conductors according to the present invention having a shielding function.

An equivalent circuit of the laminated band-pass filter in FIG. 3 is similar to that of Embodiment 1 and is shown in FIGS. 2(*a*) and 2(*b*).

This circuit differs from Embodiment 1 in that the capacitive conductors of the two band-pass filters which have similar circuit functions are arranged on different planes.

That is, the capacitive conductors 341 and 342, which form the capacitances 203 and 204 of FIG. 2(*a*), the resonator capacitive conductors of the first band-pass filter, are arranged on the dielectric layer 309, and the capacitive conductors 321 and 322, which form the capacitances 211 and 212 of FIG. 2(*b*), the resonator capacitive conductors of the second band-pass filter, are arranged on the dielectric layer 302. Further, the capacitances 201 and 202 of FIG. 2(*a*), the input and output capacitive conductors of the first band-pass filter, are arranged on the dielectric layer 304, and the capacitances 209 and 210 of FIG. 2(*b*), the input and output capacitive conductors of the second band-pass filter, are arranged on the dielectric layer 307.

As described above, according to Embodiment 2, not only effects similar to those of Embodiment 1 of the present invention are produced but also the capacitive conductors having similar circuit functions are formed on the different dielectric layers, thereby enabling the interference between the capacitive conductors constituting the two band-pass filters to be reduced to ensure that the two band-pass filters are isolated from each other.

Embodiment 3

A laminated filter according to Embodiment 3 of the present invention will be described below with reference to the drawings.

Figure 6:
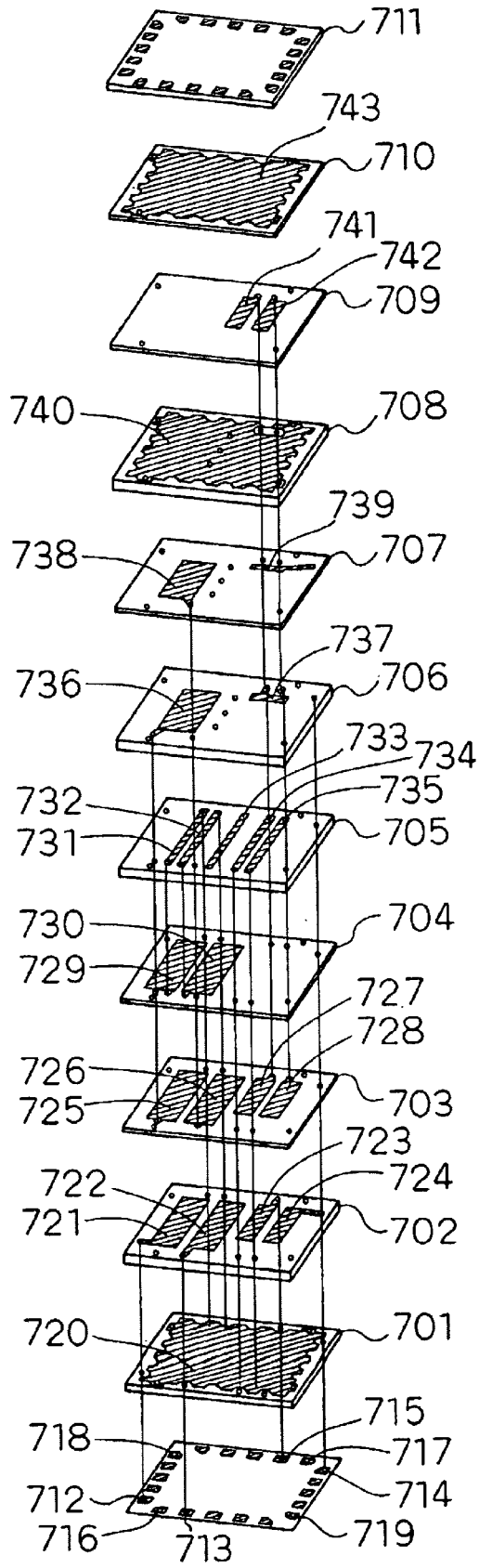
FIG. 6 is an exploded perspective view of a laminated band-pass filter according to Embodiment 3 of the present invention.

FIG. 6 is an exploded perspective view of the laminated filter according to Embodiment 3 of the present invention.

In this embodiment, the first filter (in the left of the drawing) is composed of a band elimination filter, whereas the second filter (in the right of the drawing) is composed of a band-pass filter.

As shown in FIG. 6, the laminated filter according to Embodiment 3 of the present invention comprises sequentially laminated dielectric layers 701, 702, 703, 704, 705, 706, 707, 708, 709, 710 and 711.

Here, the integrated device has a size of 5.0×5.0 mm and a height of 0.8 mm. Further, each dielectric layer is composed of a crystal phase having a dielectric constant $\epsilon r$ of 7 and a glass phase. The crystal phase is composed of $Mg_2SiO_4$, whereas the glass phase is composed of Si—Ba—La—B—O-system.

The integrated device has input and output terminals 712, 713, 714 and 715 and grounding terminals 716, 717, 718 and 719 formed on a bottom surface thereof.

The dielectric layers 701, 708, and 710 have internal grounding conductors 720, 740, and 743, respectively, arranged on top surfaces thereof and connected to the grounding terminals 716, 717, 718 and 719 through via conductors. The dielectric layer 702 has capacitive conductors 721, 722, 723 and 724 arranged on a top surface thereof and connected to the grounding terminals 712, 713 and 714 through via conductors.

The dielectric layer 703 has capacitive conductors 725, 726, 727 and 728 arranged on a top surface thereof, and the dielectric layer 704 has capacitive conductors 729 and 730 arranged on a top surface thereof. Further, the dielectric layer 705 has strip line conductors 731, 732, 733, 734 and 735 arranged on a top surface thereof, and the dielectric layer 706 has capacitive conductors 736 and 737 arranged on a top surface thereof. Furthermore, the dielectric layer 707 has capacitive conductors 738 and 739 arranged on a top surface thereof, and the dielectric layer 709 has capacitive conductors 741 and 742 arranged on a top surface thereof.

The strip line conductor 731 has one end thereof connected to the internal grounding conductor 720 through a via conductor and the other end thereof connected to the capacitive conductor 729 through a via conductor. Further, the strip line conductor 732 has one end thereof connected to the internal grounding conductor 720 through a via conductor and the other end thereof connected to the capacitive conductor 730 through a via conductor. Furthermore, the strip line conductor 734 has one end thereof connected to the internal grounding conductor 720 through a via conductor and the other end thereof connected to each of the capacitive conductors 727, 737, and 741 through a via conductor. Moreover, the strip line conductor 735 has one end thereof connected to the internal grounding conductor 720 through a via conductor and the other end thereof connected to each of the capacitive conductors 728, 739, and 742 through a via conductor.

The capacitive conductor 725 is connected to the capacitive conductor 736 through a via conductor, and the capacitive conductor 726 is connected to the capacitive conductor 738 through a via conductor. Further, the capacitive conductor 739 is arranged opposite the capacitive conductor 737 and connected to the input and output terminal 714 through a via conductor. Furthermore, the strip line conductor 733 is connected to the internal grounding conductor 740 through three via conductors.

Now, the circuit configuration of the laminated filter constructed as described above will be described with reference to FIGS. 2(*b*) and 7.

This circuit differs from Embodiments 1 and 2, described previously, in that one of the two filters is composed of a band elimination filter. That is, in the laminated filter (see FIG. 6) of this embodiment, the first filter (in the left of the drawing) is composed of a band elimination filter, whereas the second filter (in the right of the drawing) is composed of a band-pass filter.

Figure 7:
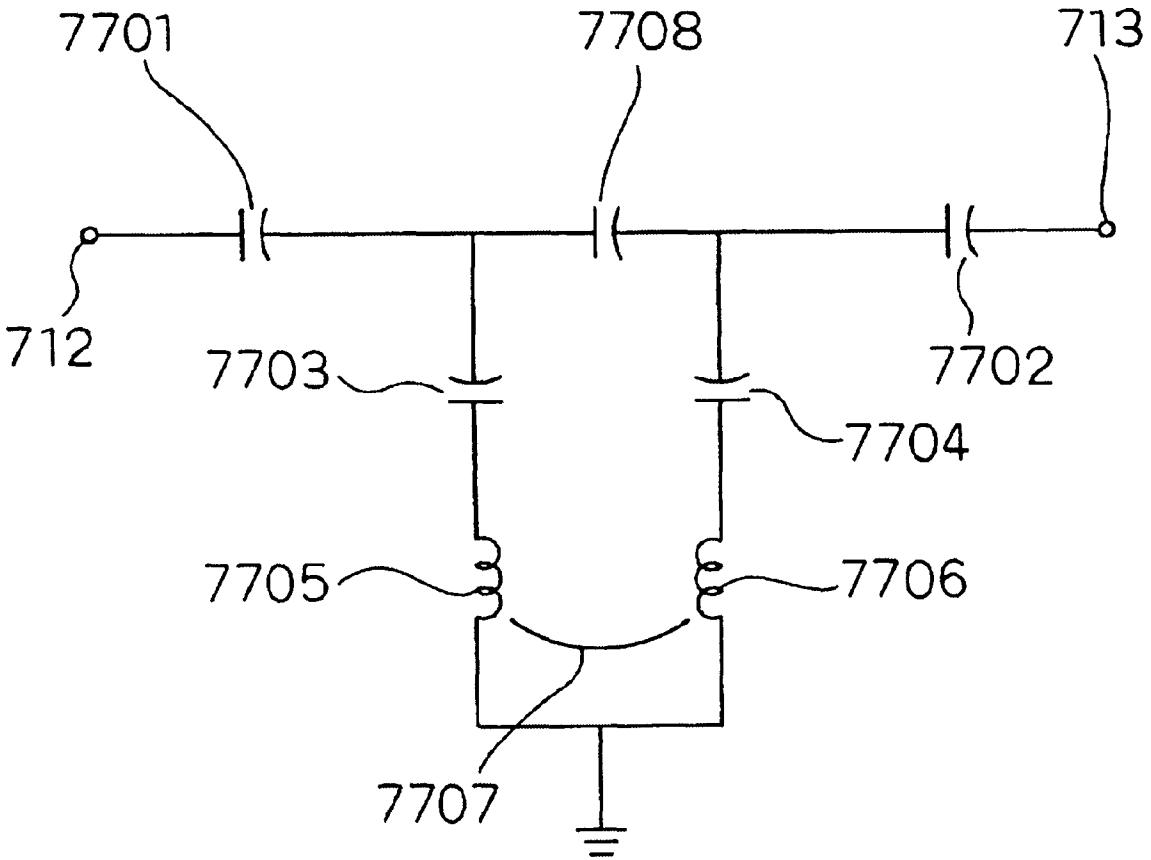
FIG. 7 is an equivalent circuit diagram of a band elimination filter according to Embodiment 3 of the present invention.

As shown in FIG. 7, a capacitance 7701 is formed by the capacitive conductors 721 and 725 of FIG. 6, and a capacitance 7702 is formed by the capacitive conductors 722 and 726. Further, a capacitance 7708 is formed by the capacitive conductors 736 and 738 of FIG. 6. Furthermore, a capacitance 7703 is formed by the capacitive conductors 725 and 729 of FIG. 6, and a capacitance 7704 is formed by the capacitive conductors 726 and 730 of FIG. 6. In this case, the capacitive conductor 725 is shared to form the capacitances 7701 and 7703, and the capacitive conductor 726 is shared to form the capacitances 7702 and 7704, thereby reducing the number of parts required.

Further, inductors 7705 and 7706 are formed by the strip line conductors 731 and 732 of FIG. 6.

The capacitances 7701 and 7702 are connected to the input and output terminals 712 and 713 of FIG. 6, respectively. Further, the inductor 7705 and the capacitance 7703 are connected together in series, the inductor 7706 and the capacitance 7704 are connected together in series, and these inductors and capacitances are coupled together by a capacitance 7708 to constitute a two-stage band elimination filter.

A mutual inductance 7707 acts between the inductors 7705 and 7706, and the capacitance 7708, connected in parallel to the mutual inductance 7707, constitutes a resonance circuit. Thus, a stop band is formed to form a first filter (band elimination filter) having the equivalent circuit in FIG. 7.

Next, the capacitance 209 of FIG. 2(*b*) is formed by the capacitive conductors 723 and 727 of FIG. 6, the capacitance 210 of FIG. 2(*b*) is formed by the capacitive conductors 724 and 728 of FIG. 6, and the capacitance 216 of FIG. 2(*b*) is formed by the capacitive conductors 737 and 739 of FIG. 6. Further, the capacitance 211 of FIG. 2(*b*) is formed by the internal grounding conductors 740 and 743 and the capacitive conductor 741, formed between the internal grounding conductors 740 and 743. Furthermore, the capacitance 212 of FIG. 2(*b*) is formed by the internal grounding conductors 740 and 743 and the capacitive conductor 742, formed between the internal grounding conductors 740 and 743.

The inductors 213 and 214 of FIG. 2(*b*) are formed by the strip line conductors 734 and 735 of FIG. 6, respectively.

Further, the capacitances 209 and 210 of FIG. 2(*b*) are connected to the input and output terminals 113 and 114, respectively. Furthermore, the inductor 213 and capacitance 211 are connected together in parallel and the inductor 214 and capacitance 212 are connected together in parallel to constitute a two-stage polarized band-pass filter.

The mutual inductance 215 of FIG. 2(*b*) acts between the inductors 213 and 214, and the capacitive conductor 739 of FIG. 6, which constitutes the cross coupling capacitance 216 of FIG. 2(*b*), is connected to the input and output terminal 714 of FIG. 6 to constitute a resonance circuit. Thus, an attenuating pole is formed on the high frequency side of the pass band to form a second filter (band-pass filter) having the equivalent circuit in FIG. 2(*b*).

The strip line conductor 733 of FIG. 6, formed on the dielectric layer 705, is grounded through the plurality of via conductors to act as a shielding conductor that inhibits the strip line conductors 731 and 732 and the strip line conductors 734 and 735, which constitute the two respective filters, from being electromagnetically coupled together.

The strip line conductor 733 corresponds to a shielding conductor according to the present invention, and the input and output terminals 712, 713, 714 and 715 correspond to input and output terminals according to the present invention. The grounding terminals 716, 717, 718 and 719 correspond to grounding terminals according to the present invention, the capacitive conductors 721, 722, 723, 724, 725, 726, 727, 728, 729 and 730, 736, 737, 738 and 739, 741, and 742 correspond to capacitive conductors according to the present invention, and the strip line conductors 731, 732, 733, 734 and 735 correspond to strip line conductors according to the present invention. Further, the dielectric layers 701, 702, 703, 704, 705, 706, 707, 708, 709, 710 and 711 correspond to dielectric layers according to the present invention, the internal grounding conductors 720, 740, and 743 correspond to grounding conductors according to the present invention, and the internal grounding conductors 720 and 743 correspond to two grounding conductors according to the present invention having a shielding function.

As described above, Embodiment 3 of the present invention not only produces the same effects as Embodiments 1 and 2, described above, but also enables two filters having different circuit configurations and different functions to be installed in one device, thereby increasing the degree of freedom of system design.

Embodiments 1 to 3 has been described in detail.

In the above described embodiments, each of the dielectric layers is, by way of example, a dielectric sheet composed of a crystal phase having a dielectric constant $\epsilon r$ of 7 and a dielectric loss tan $\delta$ of $2.0\times10^{-4}$ as well as a glass phase. However, similar effects are produced by using a dielectric sheet composed of a crystal phase having a dielectric constant $\epsilon r$ of 5 to 10 and a glass phase. Further, by way of example, the crystal phase is $Mg_2SiO_4$, and the glass phase is an Si—Ba—La—B—O system. Similar effects are produced by using a crystal phase containing at least one of $Al_2O_3$, MgO, $SiO_2$, and ROa and a glass phase. Here, in ROa, R denotes an element selected from a group consisting of La, Ce, Pr, Nd, Sm, and Gd, and a denotes a numerical value stoichiometrically determined depending on the valence of R. Further, in the above description, the integrated device has a size of 5.0×5.0 mm and a height of 0.8 mm by way of example, but similar effects are produced regardless of the size or height of the integrated device.

Figure 8:
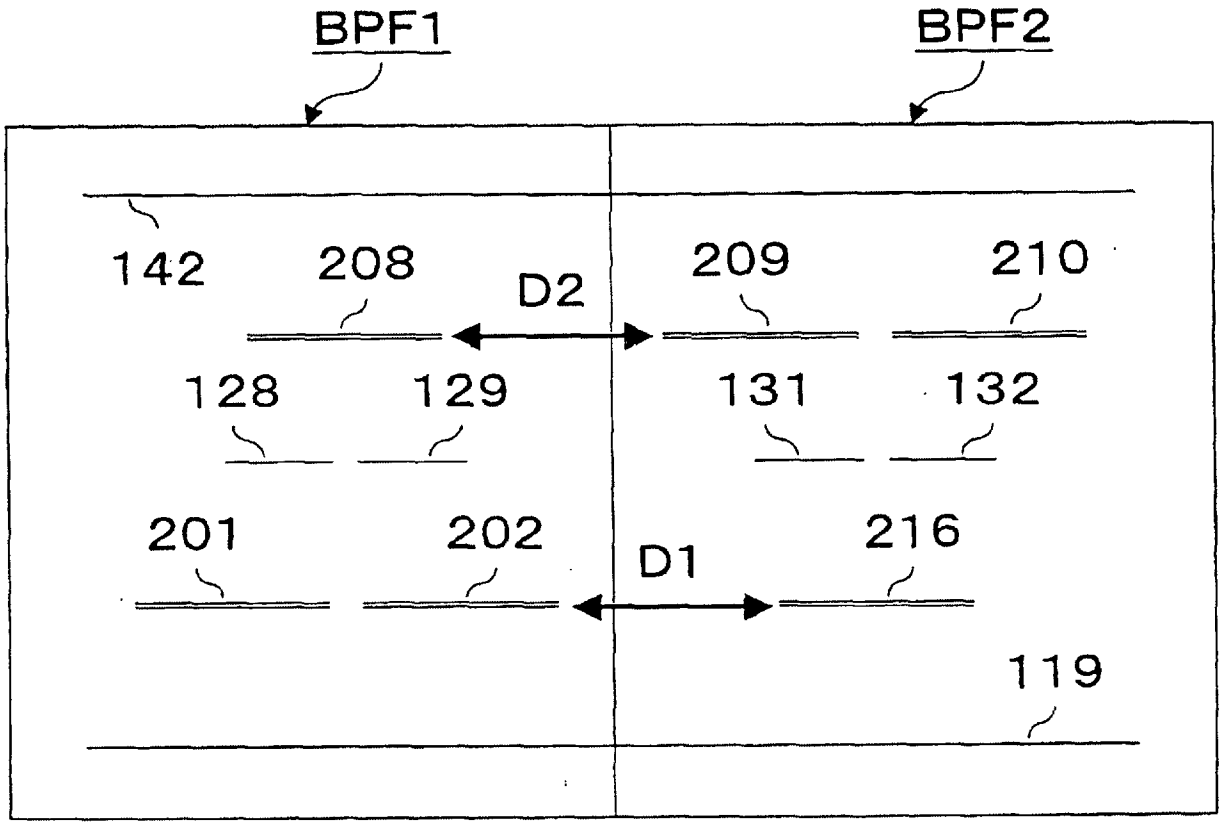
FIG. 8 is a diagram illustrating another example of a laminated structure of the laminated band-pass filter according to Embodiment 1 of the present invention.

Further, in the above described Embodiment 1 of the present invention, for example, (1) the layer having the capacitances 201 and 202 (see FIG. 2(*a*)), the input and output capacitive conductors of the first band-pass filter and the layer having the capacitances 209 and 210(see FIG. 2(*b*)), the input and output capacitive conductors of the second band-pass filter are present in the equal layer of the integrated device, and (2) the layer having the capacitance 208 (see FIG. 2(*a*)), the interstage capacitive conductor of the first band-pass filter and the layer having the capacitance 216 (see FIG. 2(*b*)), the cross coupling capacitive conductors of the second band-pass filter are present in the equal layer of the integrated device. However, the present invention is not limited to this aspect, but as shown in FIG. 8 illustrating another example of the laminated structure of the laminated band-pass filter according to Embodiment 1 of the present invention, (1) the layer having the capacitances 201 and 202, the input and output capacitive conductors of the first band-pass filter BPF1 and the layer having the capacitances 209 and 210, the input and output capacitive conductors of the second band-pass filter BPF2 may be present in different layers of the integrated device, and (2) the layer having the capacitance 208, the interstage capacitive conductor and the layer having the capacitance 216, the cross coupling capacitive conductors may be present in different layers of the integrated device (in FIG. 8, the capacitances 201 and 202 and the capacitance 216 are disposed on the same layer with a sufficient distance D1 therebetween, whereas the capacitance 208 and the capacitances 209 and 210 are disposed on the same layer with a sufficient distance D2 therebetween). Thus, if the capacitive conductors having similar circuit functions are formed on different dielectric layers, the interference between the capacitive conductors constituting the two filters can be further reduced, thereby ensuring that the two filters are isolated from each other. Of course, if the at least one of the first and second filters of the present invention is a band elimination filter, similar arrangements further ensure that the two filters are isolated from each other.

Completing description of FIG. 8, there is shown top layer 142, bottom layer 119, and strip lines conductors 128, 129, 131 and 132.

Further, the two filters in the laminated filter of each embodiment described above may have different frequency characteristics. If the two filters have different frequency characteristics, the conductors constituting the filter using lower frequencies as a pass band may have a larger occupied volume than the conductors constituting the other filter. However, if the first and second filters of the present invention are of the same type (for example, if both first and second filters are band elimination filters), an arrangement similar to the one described above is expected to improve the filter characteristics, but if the first and second filters of the present invention are of different types (for example, if the first filter is a band-pass filter and the second filter is a band elimination filters), this arrangement may not be effective because the circuit configurations will be different. More specifically, the above described improvement of the filter characteristics is a decrease in loss in the pass band if a band-pass filter is used or a sufficient amount of attenuation in the stop band if a band elimination filter is used.

Further, circuit elements such as capacitors or inductors may be arranged which are matched to an LNA (Low Noise Amplifier) or mixer preceding or following the laminated filter of each of the above described embodiments so that the input and output terminals of the two filters of the laminated filter are electrically connected to the circuit elements.

Figure 11:
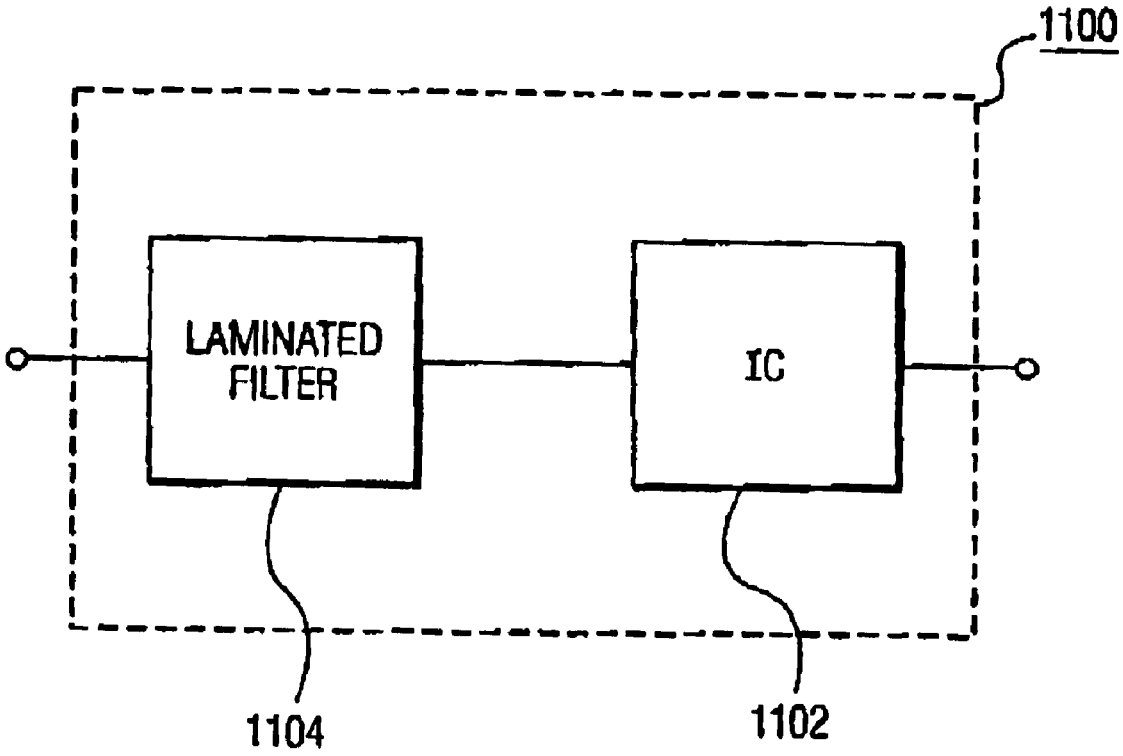
FIG. 11 illustrates an integrated device including an IC connected to the laminated filter of the present invention.

A integrated device, designated as 1100 in FIG. 11, includes IC (Integrated Circuit) 1102 the device being formed by mounting the IC containing an LNA or a mixer, on the integrated device containing laminated filter 1104 of the present invention and connecting IC 1102 to laminated filter 1104.

Figure 9:
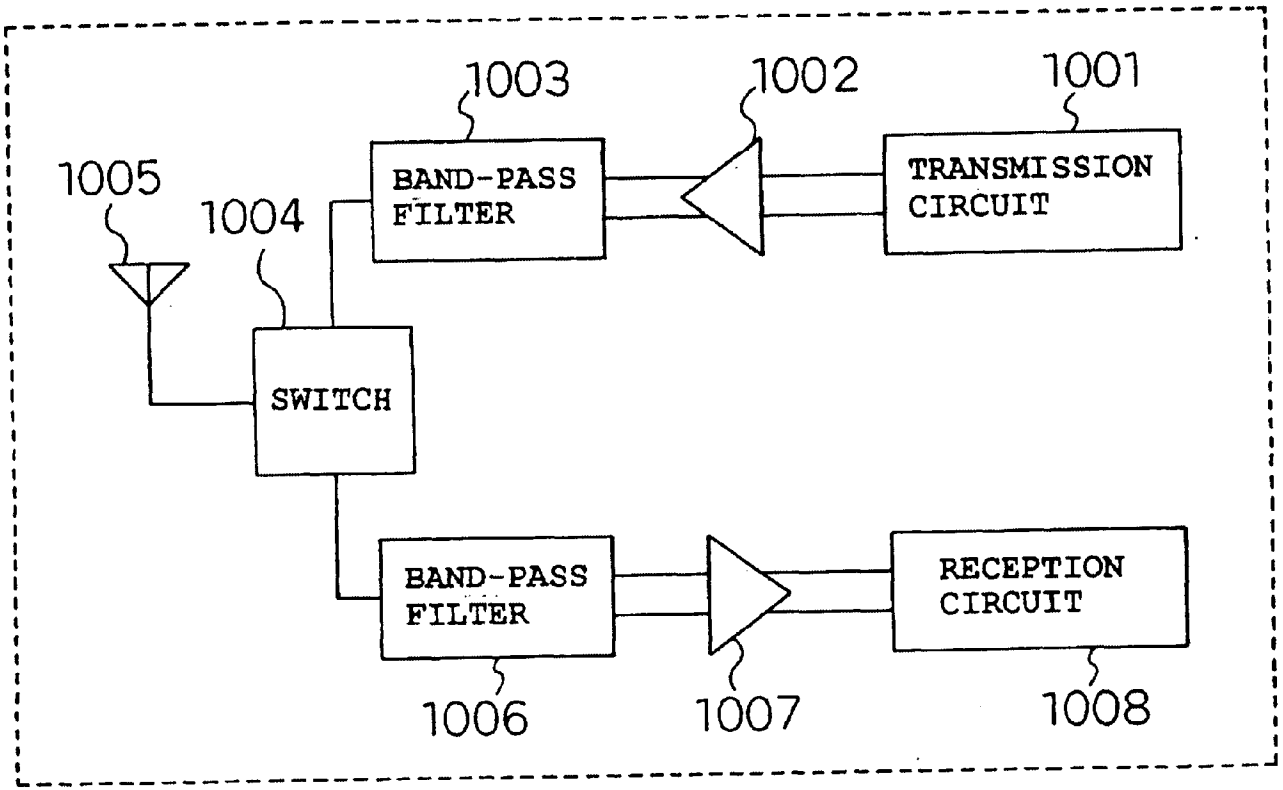
FIG. 9 is a diagram showing the configuration of a communication apparatus according to an embodiment of the present invention.
Figure 10:
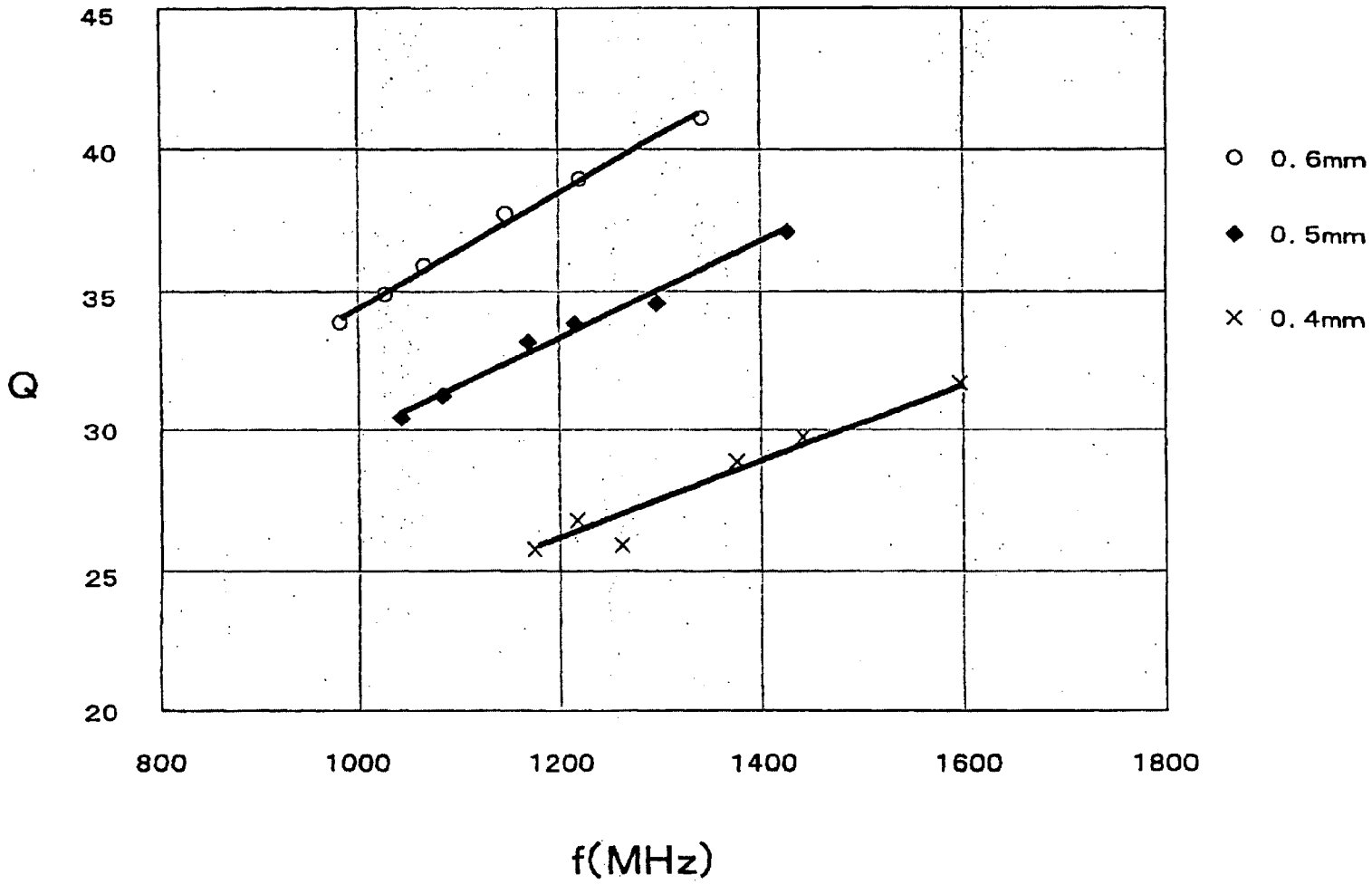
Fig. 10 PRIOR ART
FIG. 10 is a chart illustrating simulation-based analysis of the behavior of the Q factor of a high-frequency resonance circuit which behavior is observed when shield interval is varied.

Further, a communication apparatus such as the one shown in FIG. 9 illustrating the configuration of a communication apparatus according to an embodiment of the present invention belongs to the present invention, the apparatus comprising a transmission circuit 1001 for executing a transmission using an amplifier 1002, a switch 1004, and an antenna 1005, a reception circuit 1008 for executing a reception using the antenna 1005, the switch 1004, and an amplifier 1007, a band-pass filter 1003, for filtering transmitted signals used for transmission, and a band-pass filter 1006 for filtering received signals used for reception.

As is apparent from the above description, the present invention has the advantage of being able to provide a small-sized and small-loss laminated filter, integrated device, and communication apparatus.

What is claimed is:

1. A laminated filter comprising:

a plurality of grounding conductors disposed inside or outside of an integrated device comprised of a plurality of dielectric layers laminated together;

a first filter sandwiched between two of said grounding conductors, said grounding conductors having a shielding function;

a second filter sandwiched between said two grounding conductors; and a single shielding conductor connected to said plurality of grounding conductors;

wherein said first filter is disposed in an area different from an area of said second filter, and a boundary area is disposed between the area of said first filter and the area of said second filter; and the single shielding conductor is disposed in said boundary area and only the single shielding conductor by itself and free-of other coupling electrodes shields electromagnetic induction between said first and second filters;

the first and second filters each including strip line conductors disposed on a single dielectric layer of the plurality of dielectric layers; and the single shielding conductor being a strip line disposed only on the single dielectric layer.

2. The laminated filter according to claim 1, wherein said first filter is a band-pass filter, and said second filter is a band-pass filter.

3. The laminated filter according to claim 2, wherein said first filter and said second filter are disposed in the different areas with the boundary area between the different areas corresponding to a predetermined cross section substantially perpendicular to said two grounding conductors.

4. The laminated filter according to claim 3, further comprising the single shielding conductor disposed substantially in said predetermined cross section.

5. The laminated filter according to claim 4, wherein via conductors are used to connect the single shielding conductor to said grounding conductors.

6. The laminated filter according to claim 2, wherein some of said plurality of grounding conductors are disposed inside said integrated device, said first filter has a plurality of input and output terminals disposed inside or outside said integrated device, a grounding terminal disposed inside or outside said integrated device, a capacitive conductor disposed inside said integrated device, and said strip line conductors disposed inside said integrated device, said grounding terminal is electrically connected to the grounding conductors disposed inside said integrated device, and said strip line conductors each have one end electrically connected to said capacitive conductor and the other end electrically connected to the grounding conductors disposed inside said integrated device.

7. The laminated filter according to claim 6, wherein said strip line conductors are two strip line conductors positioned in parallel, and each of said two parallel strip line conductors do not contact each other.

8. The laminated filter according to claim 6, wherein said plurality of input and output terminals are two input and output terminals installed in proximity to each other, said grounding terminal is provided between said two input and output terminals installed in proximity to each other.

9. The laminated filter according to claim 6, wherein said second filter has another plurality of input and output terminals disposed inside or outside said integrated device, and the plurality of input and output terminals of said first filter and the other plurality of input and output terminals of said second filter are provided in the same layer of said integrated device symmetrically with respect to a center of the same layer.

10. The laminated filter according to claim 6, further comprising a predetermined circuit element electrically connected to said plurality of input and output terminals.

11. The laminated filter according to claim 2, wherein a crystal forming the dielectric layers of said integrated device is selected from a group consisting of $Al_2O_3$, MgO, $SiO_2$, and ROa for R denoting at least one of La, Ce, Pr, Nd, Sm, and Gd and a denoting a numerical value stoichiometrically determined depending on the valence of said R.

12. The laminated filter according to claim 2, wherein said first filter has said strip line conductors disposed substantially midway between said two grounding conductors in a thickness direction of said integrated device.

13. The laminated filter according to claim 2, wherein said first filter has a plurality of capacitive conductors and said strip line conductors, and of said plurality of capacitive conductors, including an interstage capacitive conductor, cross coupling capacitive conductor, and input and output capacitive conductors are disposed substantially midway between either of said two grounding conductors and said strip line conductors in a thickness direction of said integrated device.

14. The laminated filter according to claim 2, wherein said first filter has a plurality of capacitive conductors and said strip line conductors, and a predetermined one of said plurality of capacitive conductors, which are connected to said strip line conductors electrically in parallel, is disposed between said two grounding conductors.

15. The laminated filter according to claim 14, further comprising a predetermined grounding conductor disposed so that said predetermined capacitive conductor is sandwiched between said predetermined grounding conductor and either of said two grounding conductors.

16. The laminated filter according to claim 2, wherein said first filter and said second filter use different frequency bands as pass bands.

17. The laminated filter according to claim 16, wherein one of said first and second filters which use a lower frequency band as a pass band has a larger volume in said integrated device.

18. The laminated filter of claim 1 wherein said first filter has a plurality of input and output terminals disposed inside or outside said integrated device, said second filter has another plurality of input and output terminals disposed inside or outside said integrated device, and the plurality of input and output terminals of said first filter and the other plurality of input and output terminals of said second filter are provided in the same layer of said integrated device symmetrically with respect to a center of the same layer.

19. The laminated filter according to claim 1, wherein said first filter is a band-pass filter, and said second filter is a band elimination filter.

20. A communication apparatus comprising:

transmitting and receiving means of executing transmission and/or reception; and a laminated filter which filters a transmitted signal used for said transmission and/or a received signal used for said reception, the laminated filter including:

a plurality of grounding conductors disposed inside or outside of an integrated device comprised of a plurality of dielectric layers laminated together;

a first filter sandwiched between two of said grounding conductors, said grounding conductors having a shielding function;

a second filter sandwiched between said two grounding conductors; and a single shielding conductor connected to said plurality of grounding conductors;

wherein said first filter is disposed in an area different from an area of said second filter, and a boundary area is disposed between the area of said first filter and the area of said second filter;

the single shielding conductor is disposed in said boundary area and only the single shielding conductor by itself and free-of other coupling electrodes shields electromagnetic induction between said first and second filters;

the first and second filters each including strip line conductors disposed on a single dielectric layer of the plurality of dielectric layers; and the single shielding conductor being a strip line disposed only on the single dielectric layer.

21. A integrated device comprising:

a laminated filter including a plurality of grounding conductors disposed inside or outside of an integrated device comprised of a plurality of dielectric layers laminated together, a first filter sandwiched between two of said grounding conductors, said grounding conductors having a shielding function, a second filter sandwiched between said two grounding conductors, and a single shielding conductor connected to said plurality of grounding conductors, wherein said first filter is disposed in an area different from an area of said second filter, and a boundary area is disposed between the area of said first filter and the area of said second filter, the single shielding conductor is disposed in said boundary area and only the single shielding conductor by itself and free-of other coupling electrodes shields electromagnetic induction between said first and second filters, the first and second filters each including strip line conductors disposed on a single dielectric layer of the plurality of dielectric layers, and the single shielding conductor being a strip line disposed only on the single dielectric layer, and an integrated circuit mounted in said integrated device.

* * * * *